US009394579B2

(12) United States Patent
Um et al.

(10) Patent No.: US 9,394,579 B2
(45) Date of Patent: Jul. 19, 2016

(54) HIGH-STRENGTH STEEL MATERIAL HAVING OUTSTANDING ULTRA-LOW-TEMPERATURE TOUGHNESS AND A PRODUCTION METHOD THEREFOR

(75) Inventors: Kyung-Keun Um, Pohang-si (KR); Jong-Kyo Choi, Pohang-si (KR); Woo-Kil Jang, Pohang-si (KR); Hee-Goon Noh, Pohang-si (KR); Hyun-Kwan Cho, Pohang-si (KR)

(73) Assignee: POSCO, Pohang-si (KR)

( * ) Notice: Subject to any disclaimer, the term of this patent is extended or adjusted under 35 U.S.C. 154(b) by 540 days.

(21) Appl. No.: 13/824,647

(22) PCT Filed: Nov. 21, 2011

(86) PCT No.: PCT/KR2011/008884

§ 371 (c)(1), (2), (4) Date: Mar. 18, 2013

(87) PCT Pub. No.: WO2012/067474

PCT Pub. Date: May 24, 2012

(65) Prior Publication Data

US 2013/0174941 A1 Jul. 11, 2013

(30) Foreign Application Priority Data

Nov. 19, 2010 (KR) ..... 10-2010-0115702

(51) Int. Cl.
*C21D 8/00* (2006.01)
*C21D 6/00* (2006.01)
(Continued)

(52) U.S. Cl.
CPC ..... *C21D 8/005* (2013.01); *C21D 6/005* (2013.01); *C21D 8/0226* (2013.01);
(Continued)

(58) Field of Classification Search
CPC ..... C21D 6/005; C21D 8/0263; C21D 8/005; C21D 8/0226; C22C 38/08; C22C 38/44; C22C 38/16; C22C 38/14; C22C 38/12; C22C 38/58; C22C 38/06; C22C 38/04; C22C 38/02; C22C 38/002; C22C 38/001
See application file for complete search history.

(56) References Cited

U.S. PATENT DOCUMENTS 4,257,808 A 3/1981 Morris, Jr. et al.
4,776,900 A * 10/1988 Yano et al. ..... 148/653
(Continued)

FOREIGN PATENT DOCUMENTS

CN 101535518 A 9/2009
CN 101868560 A 10/2010
(Continued)

*Primary Examiner* — Veronica F Faison
(74) *Attorney, Agent, or Firm* — The Webb Law Firm

(57) ABSTRACT

The present invention provides steel containing manganese and nickel that is used as a structural material for a cryogenic storage container for liquefied natural gas (LNG) or the like, and a manufacturing method thereof; and more particularly, to steel having good cryogenic temperature toughness and also high strength by adding low-cost Mn instead of relatively expensive Ni at an optimized ratio, refining a microstructure through controlled rolling and cooling, and precipitating retained austenite through tempering, and a manufacturing method of the steel. To achieve the object, the technical feature of the present invention is a method of manufacturing high-strength steel with cryogenic temperature toughness. In the method, a steel slab is heated to a temperature within a range of 1,000 to 1,250° C., wherein the steel slab includes, by weight: 0.01-0.06% of carbon (C), 2.0-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (S), with a remainder of iron (Fe) and other unavoidable impurities. Then, the heated slab is finish-rolled at a temperature of 950° C. or less at a rolling reduction rate of 40% or more. The rolled steel is cooled to a temperature of 400° C. or less at a cooling rate of 2° C./s or more. Thereafter, the steel is tempered for 0.5-4 hours to a temperature within a range of 550 to 650° C. after the cooling.

12 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/44*** | (2006.01) |
| ***C22C 38/58*** | (2006.01) |

(52) U.S. Cl.

CPC ..... *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/44* (2013.01); *C22C 38/58* (2013.01)

(56) References Cited

U.S. PATENT DOCUMENTS

| | | | | |
|---|---|---|---|---|
| 5,798,004 | A | 8/1998 | Tamehiro et al. | |
| 6,162,389 | A | 12/2000 | Hase et al. | |
| 6,251,198 | B1 * | 6/2001 | Koo et al. | 148/332 |
| 2010/0074794 | A1 | 3/2010 | Ahn et al. | |
| 2010/0263773 | A1 | 10/2010 | Cho et al. | |

FOREIGN PATENT DOCUMENTS

| | | | |
|---|---|---|---|
| GB | 1413877 | | 11/1975 |
| JP | S50-145314 | A | 11/1975 |
| JP | 8199292 | A | 8/1996 |
| JP | 1171640 | A | 3/1999 |
| JP | 2001527155 | A | 12/2001 |
| JP | 2007080646 | A | 3/2007 |
| KR | 19970043139 | A | 7/1997 |
| KR | 1020100032490 | A | 3/2010 |
| WO | 9932672 | A1 | 7/1999 |
| WO | 2010052927 | A1 | 5/2010 |

* cited by examiner

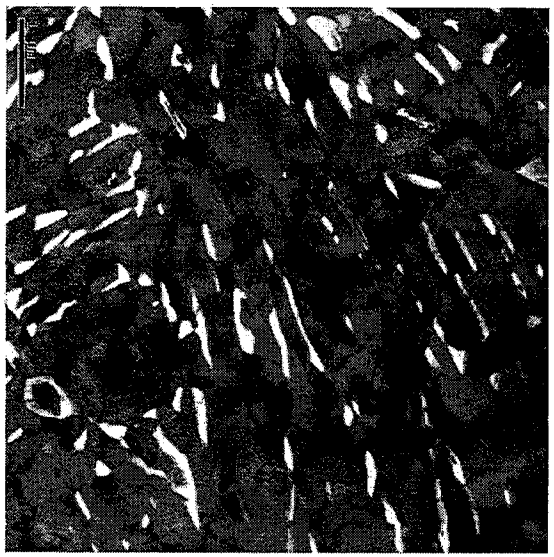

HIGH-STRENGTH STEEL MATERIAL HAVING OUTSTANDING ULTRA-LOW-TEMPERATURE TOUGHNESS AND A PRODUCTION METHOD THEREFOR

TECHNICAL FIELD

The present invention relates to steel containing manganese and nickel used as a structural material for a cryogenic storage container for liquefied natural gas (LNG) or the like, and a manufacturing method thereof; and more particularly, to steel having good cryogenic temperature toughness and also high strength by adding relatively low-cost manganese (Mn) instead of relatively expensive nickel (Ni) at an optimized ratio, refining a microstructure through controlled rolling and cooling, and precipitating retained austenite through tempering, and a manufacturing method of the steel.

BACKGROUND ART

As methods for improving the cryogenic temperature toughness of steel, those that involve refining grain structures and adding alloying elements such as Ni are well known.

The method of refining grain structures, among many existing metal processing methods is known as the only method capable of simultaneously improving strength and toughness. This is due to the fact that when the grain is refined, the dislocation density accumulated at the grain boundary is lowered, and the stress concentration on adjacent grain crystals is reduced to prevent breaking strength from being reached, resulting in good toughness.

However, in typical carbon steel, grain refining able to be obtained through controlled rolling and cooling such as a TMCP is about 5 um, and toughness abruptly decreases at a maximum temperature of about −60° C. or below. Also, even when grain size is reduced to 1 um or below through repeated heat treatments, toughness abruptly decreases at about −100° C. and below, so that brittleness occurs at the cryogenic temperature of about −165° C. in an LNG storage tank. Accordingly, steel that has been used to date to cope with the cryogenic temperature of −165° C. in LNG storage tanks has been obtained through both grain refinement and the addition of Ni or the like to secure cryogenic temperature toughness.

In general, strength is usually increased but toughness is decreased when a substitutional alloying element is added to steel. However, it is shown in documents that the addition of an element such as platinum (Pt), nickel (Ni), ruthenium (Ru), rhodium (Rh), iridium (Ir), or rhenium (Re) actually produces an improvement in toughness. Therefore, while the addition of such an alloying element may be considered, the only commercially available element thereamong is Ni.

The steel that has been used over the preceding several decades as cryogenic steel is steel that contains 9% Ni (hereinafter called "9% Ni steel"). For 9% Ni steel in general, after reheating and quenching (Q), a fine martensite structure is made, and then the martensite structure is softened by tempering (T) and retained austenite is simultaneously precipitated by about 15%. Accordingly, the fine lath of the martensite is restored by tempering and given a fine structure of several hundred nm, and austenite of several tens of nm is produced between laths, so that a fine overall structure of several hundred nm is obtained. In addition, by adding 9% Ni, the steel is provided with improved cryogenic temperature toughness properties. Despite having high strength and good cryogenic temperature toughness, however, the use of 9% Ni steel is limited due to the large amount of relatively high-cost Ni that must be added thereto.

To overcome this limitation, techniques have been developed for using Mn instead of Ni to obtain a similar fine structure. U.S. Pat. No. 4,257,808 discloses a technology in which 5% Mn is added instead of 9% Ni, and the resultant steel is subjected to repeated heat treatments four times in an austenite+ferrite two-phase region temperature range to refine the grain structure, after which tempering is performed to improve cryogenic temperature toughness. Laid-open patent 1997-0043139 discloses a technology which similarly adds 13% Mn and subjects the resultant steel to repeated heat treatment four times in an austenite+ferrite two-phase region temperature range to refine the grain structure in a similar manner, after which tempering is performed in order to improve cryogenic temperature toughness.

Another technology is one in which the existing 9% Ni manufacturing process is retained, the amount of Ni is lowered from 9%, and instead, Mn, Cr, or the like is added. Japanese Patent Application Laid-open No. 2007/080646 is a patent in which the amount of added Ni is 5.5% or greater, and instead, Mn and Cr are added in the amounts of 2.0% and 1.5% or less, respectively.

However, the above patents can only obtain a fine structure when repeated heat treatments are performed four or more times and tempering is then performed, whereupon a steel material may be manufactured having good cryogenic temperature toughness. Therefore, due to the added number of times that a heat treatment is performed over the existing two heat treatments, the drawbacks arise from the added heat treatment costs and the requirement for heat treating equipment.

SUMMARY OF THE INVENTION

An aspect of the present invention provides steel with cryogenic temperature toughness which maintains the same microstructure as 9% Ni steel having cryogenic temperature toughness and has strength as high as that of conventional 9% Ni steel by using Mn and Cr instead of Ni to optimize the correlation of Ni with Mn and Cr, and a manufacturing method of the steel with cryogenic temperature toughness.

According to an aspect of the present invention, there is provided high-strength steel with good cryogenic temperature toughness, including, by weight: 0.01-0.06% of carbon (C), 2.0-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (5), the with a remainder of iron (Fe) and other unavoidable impurities.

The high-strength steel may further include, by weight, at least one selected from the group consisting of 0.003-0.055 of titanium (Ti), 0.1-5.0% of chromium (Cr) and 0.1-3.0% of copper (Cu).

The Mn and the Ni may satisfy the condition of $8 \leq 1.5 \times Mn + Ni \leq 12$.

The steel may have a main phase of martensite, 10 vol % or less of bainite, and 3-15 vol % of retained austenite.

According to another aspect of the present invention, there is provided a method of manufacturing high-strength steel with cryogenic temperature toughness, including: heating a steel slab to a temperature within a range of 1,000 to 1,250° C., the steel slab comprising, by weight: 0.01-0.06% of carbon (C), 2.0-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (S), with a remainder of iron (Fe) and other unavoidable impurities; finish-rolling the heated slab at a temperature of 950° C. or less at a rolling reduction rate of 40% or more; cooling the rolled steel to a temperature of 400° C. or less at a cooling rate of 2° C./s or more; and tempering the steel for 0.5-4 hours to a temperature within a range of 550 to 650° C. after the cooling.

According to the present invention, by optimally controlling an alloy composition and rolling, cooling and heat treatment processes, it is possible to manufacture high-strength structural steel which has a yield strength of 500 MPa or higher while reducing the amount of relatively expensive Ni used, and also has good cryogenic temperature toughness such that the cryogenic impact energy is 70 J or higher at −196° C. or lower

DESCRIPTION OF DRAWING

The above and other aspects, features and other advantages of the present invention will be more clearly understood from the following detailed description taken in conjunction with the accompanying drawing, in which:

The drawing depicts a transmission electron microscope (TEM) image of inventive steel according to the present invention, which shows a microstructure of the inventive steel.

DETAILED DESCRIPTION OF THE INVENTION

Exemplary embodiments of the present invention will now be described in detail with reference to the accompanying drawings.

To reduce the amount of Ni of alloying elements in 9% Ni steel and allow steel to have strength as high as 9% Ni steel and good cryogenic temperature toughness using low-cost Mn and Cr instead of relatively expensive Ni, the present invention provides steel and a manufacturing method thereof, wherein the steel comprises, by weight, 0.01-0.06% of carbon (C), 2.0-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (S), with a remainder of iron (Fe) and other unavoidable impurities, and has the yield strength of 500 MPa or higher and the cryogenic impact energy of 70 J or higher at about −196° C.

Hereinafter, the present invention will be described in detail.

First, a component system and a composition range of steel according to the present invention will be described in detail (The amount of each element is given in weight percentage below).

Carbon (C): 0.01-0.06%

In the present invention, C is the most important element to precipitate as austenite in carbides or the like in austenite grain boundaries, between laths of martensites, and within bainites. Thus, a suitable amount of C should be contained in the steel.

If the amount of C is less than 0.01%, steel hardenability is poor when the steel is cooled after controlled rolling, to thus cause coarse bainite to be formed or retained austenite created during tempering to have a fraction of 3% or less, thereby lowering cryogenic temperature toughness. Also, if the amount of C is greater than 0.06%, the strength of the steel becomes too high so that cryogenic temperature toughness is lowered once more. Therefore, the amount of C is preferably limited to between 0.01% and 0.06%.

Silicon (Si): 0.03-0.5%

Si is mainly used as a deoxidizing agent and is a useful element due to having effectiveness in strengthening. Also, Si may increase the stability of retained austenite to thus form greater amount of austenite even with smaller amount of C.

However, if the amount of Si is greater than 0.5%, both cryogenic temperature toughness and weldability are severely deteriorated; and if the amount of Si is less than 0.03%, the deoxidizing effect becomes insufficient, and thus the amount of Si is preferably limited to between 0.03% and 0.5%.

Nickel (Ni): 0.01-6.0%

Ni is almost a unique element, capable of simultaneously improving both the strength and the toughness of a base material. To achieve such an effect, 0.01% or more of Ni should be added. However, the addition of 6.0% or more of Ni is economically infeasible, so that the amount of Ni is limited to 6.0% or less. Therefore, the amount of Ni is preferably limited to between 0.01% and 6.0%.

Manganese (Mn): 2.0-8.0%

Mn has the effect of increasing the stability of austenite, to be similar to that of Ni. 2.0% or more of Mn should be added instead of Ni in order for the steel to exhibit such an effect, and if the amount of Mn added is greater than 8.0%, the excessive hardenability causes cryogenic temperature toughness to be greatly lowered. Therefore, the amount of Mn is preferably limited to between 2.0% and 8.0%.

Also, said Mn and Ni preferably satisfy the condition of $8 \leq 1.5 \times Mn + Ni \leq 12$. If the value of $1.5 \times Mn + Ni$ is less than 8, retained austenite becomes unstable to deteriorate cryogenic temperature toughness because hardenability is not sufficiently secured. If the value is greater than 12, the excessive increase in strength results in deterioration of cryogenic temperature toughness once more. Also, when 0.733% of Mn is added instead of 1% of Ni, improvement in cryogenic temperature toughness is maximized. Therefore, it is more preferable to satisfy the equation of $1.5 \times Mn + Ni = 10$.

Molybdenum (Mo): 0.02-0.06%

The addition of an only small amount of Mo may significantly enhance hardenability to refine the structure of martensite and also improve the stability of retained austenite, thereby increasing cryogenic temperature toughness. Also, Mo inhibits the segregation of P and the like in grain boundaries to suppress the intergranular fracture. In order to achieve such an effect, Mo should be added in an amount of 0.02% or more. However, if the amount of Mo is greater than 0.6%, the strength of steel is excessively increased thus to cause cryogenic temperature toughness to be degraded. Therefore, the amount of Mo is preferably limited to between 0.02% and 0.6%.

For cryogenic temperature toughness, it is preferable that the amount of Mo be in the range of 0.02% to 0.6% and furthermore, it is more preferable that the amount of Mo be in the range of 5% to 10% of Mn contents. If the amount of Mn is increased, the binding energy of grain boundaries is decreased. However, when Mo is added in a certain amount proportional to the amount of Mn added, the binding energy of grain boundaries is increased to prevent the toughness from being deteriorated.

Phosphorus (P): 0.02% or less

Since P is an element which is beneficial in terms of strengthening and corrosion resistance, but which greatly lowers impact toughness, the amount of P is preferably limited to 0.02% or less.

Sulfur (S): 0.01% or less

Since S greatly lowers the impact toughness due to the formation of MnS, it is favorable to maintain the amount of S as low as possible and thus the amount of S is preferably limited to 0.01% or less.

Aluminum (Al): 0.003%-0.05%

It is preferable to add 0.003% or more of Al because Al enables molten steel to be deoxidized while incurring low manufacturing costs. However, the amount of Al exceeding 0.05% results in nozzle clogging during continuous casting and facilitates the formation of a martensite-austenite (MA) constituent during welding, detrimental to the impact toughness of welded parts. Therefore, the amount of Al is preferably limited to between 0.003% and 0.05%.

Nitrogen (N): 0.0015%-0.01%

If N is added, the fraction and stability of retained austenite are increased to improve cryogenic temperature toughness. However, the amount of N is necessarily limited to 0.01% or less as it is re-resolved in a heat affected zone, thereby greatly lowering cryogenic impact toughness. However, if the amount of N is controlled to be less than 0.0015%, the load of a steelmaking process is increased. Therefore, in the present invention, the amount of N is limited to 0.0015% or more.

Steel with the advantageous steel composition of the present invention has the sufficient effects by only containing alloying elements within the above-mentioned ranges. However, in order to improve overall characteristics, such as strength and toughness of steel, and toughness and weldability of a weld heat-affected-zone (HAZ), it is preferable that the steel further includes at least one element selected from the group consisting of the 0.003-0.05% of titanium (Ti), 0.1-5.0% of chromium (Cr), and 0.1-3.0% of copper (Cu).

Titanium (Ti): 0.003%-0.05%

The addition of Ti suppresses grain growth during heating to significantly improve low-temperature toughness. 0.003% or more of Ti should be added to exhibit such an effect, but the addition of 0.05% more of Ti causes some problems, such as clogging of a continuous casting nozzle and a decrease in low-temperature toughness by central crystallization. Therefore, the amount of Ti is preferably limited to between 0.003% and 0.05%.

Chromium (Cr): 0.1%-5.0%

Cr has the effect of increasing the hardenability like Ni and Mn, and 0.1% or more of Cr should be added to transform the microstructure to the martensite structure after controlled rolling. However, if Cr is added in an amount of 5.0% or more, weldability is significantly lowered. Therefore, the amount of Cr is preferably limited to between 0.1% and 5.0%.

Copper (Cu): 0.1%-3.0%

Cu is an element which can minimize degradation of the toughness of the base material and increase the strength at the same time. It is preferable to add 0.1% or more of Cu to exhibit such an effect; however, if Cu is added in an excessive amount beyond 3.0%, it greatly impairs the surface quality of a product. Therefore, the amount of Cu is preferably limited to between 0.1% and 3.0%.

In addition, when Cr or Cu is added in the place of Mn to serve the same role as Mn in the present invention, it is preferable that the following condition of $8 \leq 1.5 \times (Mn+Cr+Cu)+Ni \leq 12$ be satisfied. In order to maximize the improvement in cryogenic temperature toughness, it is preferable that the relation of $1.5 \times (Mn+Cr+Cu)+Ni=10$ be satisfied.

Preferably, the microstructure of steel according to the present invention has the main phase composed of martensite or includes 3-15% of retained austenite along with a mixed phase of martensite and 10% or less of bainite. More preferably, the main phase of the microstructure has martensite of a lath structure, or includes 3-15% of retained austenite along with a mixed phase of martensite and 10% or less of bainite.

FIG. 1 is a photograph illustrating a microstructure of steel according to the present invention, in which a white portion represents retained austenite and the black portion represents tempered martensite lath. As confirmed from FIG. 1, the steel of the present invention preferably has the microstructure in which about 3-15% of the retained austenite with a size of several hundred nm dispersed between fine martensite laths transformed from austenite of 50 μm or less, or in the martensite lath and the bainite. The fine martensite lath structure and the retained austenite segmenting the martensite lath structure more finely, may allow steel to have good cryogenic temperature toughness.

Hereinafter, a method of manufacturing the above-described steel of the present invention will be explained.

According to the present invention, the steel slab having the above-described composition is heated, then rolled to sufficiently elongate the austenite, and the steel with the elongated austenite is cooled to form fine martensite or form fine martensite and 10 vol % or less of fine bainite. Thereafter, a tempering process is performed to finely disperse and precipitate 3% or more of retained austenite between martensite laths or in the martensite lath and bainite to thereby manufacture steel having good cryogenic temperature toughness.

The heating of the slab is preferably performed to a temperature of 1,050 to 1,250° C. The heating temperature of the slab is required to be 1,050° C. or over to dissolve Ti carbonitride formed during casting and to homogenize carbon, etc. However, when the heating is performed at an excessively high temperature exceeding 1,250° C., the austenite is likely to be coarsened. Thus, the heating temperature is preferably within the range of 1,050 to 1,250° C.

In order to adjust the shape of the heated slab, rough rolling is preferably performed at 1,000 to 1,250° C. after heating. Through the rolling, the cast structure of dendrite, and the like formed during the casting may be broken, and also the size of the austenite may be reduced. However, when the rough rolling is performed at an excessively low temperature of 1,000° C. or below, the strength of the steel is largely increased to deteriorate rolling properties thus leading to significant decrease in productivity. When the rough rolling is performed at an excessively high temperature of 1,250° C. or above, the austenite grain in a raw material may be coarsened during rolling to deteriorate low-temperature toughness. Thus, the rough rolling is preferably performed at a temperature of 1,000 to 1,250° C.

Finishing rolling is performed at a temperature of 950° C. or less in order to refine the austenite of the roughly rolled steel and to accumulate a high amount of energy in the austenite grain by inhibiting recrystallization. Through the finishing rolling, the austenite grain may be elongated lengthily in the form of a pancake to achieve the effect of refining the austenite grain. However, when the rolling temperature is 700° C. or less, high-temperature strength is rapidly increased to make it difficult to perform the rolling process. Therefore, the temperature of the finishing rolling is preferably in the range of 700 to 950° C. In addition, the rolling reduction during the finishing rolling is 40% or more to allow the austenite to be sufficiently elongated.

After the finishing rolling, cooling is performed at a cooling rate of 2° C./s or more. When the cooling is performed at the cooling rate of 2° C./s or more, the transformation of the elongated austenite into coarse bainite may be prevented, and the elongated austenite may be transformed into mostly martensite or martensite along with a portion of fine bainite. In addition, since the generation of coarse bainite may be prevented when the cooling is performed at a temperature less than or equal to the Ms temperature of steel, the cooling ending temperature is preferably limited to 400° C. or less.

After the cooling, a tempering process is preferably performed at 550 to 650° C. for 0.5 to 4 hours.

When the cooled steel is maintained at 550° C. or higher for 0.5 hour or more, fine austenite may be produced from cementite between the fine martensite laths or in the bainite, and may remain as not being transformed during cooling. That is, the austenite may be present between fine martensite laths or in martensite lath and bainite. However, when the tempering temperature is 650° C. or higher, or the tempering duration is 4 hours or over, the fraction of the precipitated austenite may be increased; however, the mechanical, thermal stability may be deteriorated, and the austenite may thus be reversely transformed into the martensite again during cooling. As a result, the strength may be largely increased and cryogenic temperature toughness may be deteriorated. After the cooling, the tempering process is preferably performed at 550 to 650° C. for 0.5 to 4 hours.

MODE FOR INVENTION

Hereinafter, the present invention will be described in detail through examples. However, it should be noted that the following examples are merely provided to explain the present invention for illustrative purpose, and are not intended to limit the scope of the present invention. The reason is because the scope of the present invention is determined by the disclosure of the claims and all the details able to be logically interfered from this disclosure.

Example

The test results of the physical properties for the steels are shown in following table 3, wherein the steel is made by rolling, cooling, and heat treatment of slabs having the compositions of following the table 1 under conditions as shown in following table 2. In table 3 below, the results of yield strength, tensile strength and elongation are measured using a uniaxial tensile test, and the result of the cryogenic impact energy is measured using a Charpy V-notch impact test at −196° C.

TABLE 1

| | C | Mn | Si | P | S | Al | Ni | Cr | Cu | Mo | Ti | N | Ca | 1.5* Mn + Ni | Remark |
|---|---|---|---|---|---|---|---|---|---|---|---|---|---|---|---|
| Inventive steel 1 | 0.031 | 6.5 | 0.11 | 0.001 | 0.002 | 0.01 | 0.1 | | | 0.45 | | 0.0032 | 0.0012 | 10 | Base 1 |
| Inventive steel 2 | 0.023 | 4.3 | 0.11 | 0.001 | 0.002 | 0.01 | 3.5 | | | 0.32 | 0.002 | 0.0046 | | 10 | Base 2 |
| Inventive steel 3 | 0.053 | 2.4 | 0.23 | 0.001 | 0.002 | 0.02 | 5.6 | | | 0.09 | | 0.0022 | 0.0005 | 9 | Base 3 |
| Inventive steel 4 | 0.043 | 4.6 | 0.18 | 0.001 | 0.001 | 0.02 | 2.5 | 1.2 | | 0.39 | | 0.0035 | | 9 | Cr |
| Inventive steel 5 | 0.027 | 5.2 | 0.24 | 0.002 | 0.002 | 0.02 | 1.2 | | 1.54 | 0.55 | | 0.0042 | | 9 | Cu |
| Inventive steel 6 | 0.052 | 4.3 | 0.32 | 0.001 | 0.002 | 0.03 | 3.5 | | | 0.24 | 0.012 | 0.0026 | | 10 | Ti |
| Comparative steel 1 | 0.002 | 3.5 | 0.15 | 0.001 | 0.003 | 0.03 | 3.6 | | 0.5 | 0.08 | | 0.0023 | | 9 | Low C |
| Comparative steel 2 | 0.086 | 4.2 | 0.18 | 0.001 | 0.002 | 0.01 | 2.2 | 0.3 | | 0.21 | | 0.0045 | 0.0012 | 9 | Excessive C |
| Comparative steel 3 | 0.043 | 3.4 | 0.31 | 0.002 | 0.002 | 0.02 | 1.5 | | | 0.21 | 0.008 | 0.0038 | | 7 | Low Mn_NI |
| Comparative steel 4 | 0.025 | 5.5 | 0.12 | 0.001 | 0.002 | 0.03 | 1.5 | | | 0.002 | | 0.0019 | | 10 | Low Mo |
| Comparative steel 5 | 0.037 | 8.8 | 0.15 | 0.001 | 0.001 | 0.03 | 1.2 | | | 0.65 | | 0.0026 | 0.0012 | 14 | Excessive Mn_Ni |
| Comparative steel 6 | 0.029 | 7.2 | 0.24 | 0.001 | 0.002 | 0.02 | 2.5 | | | 0.52 | | 0.0042 | | 13 | Excessive Mn_Ni |

The amount of each element in table 1 is given in weight percentage, and, as described above, the inventive steels 1-6 which meet the composition of the steel within the scope of the present invention and the comparative steels 1-6 which fall outside of the scope of the present invention are listed in table 1.

TABLE 2

| | Type of steel | Slab thickness (mm) | Heating furnace extraction temp. (° C.) | Rough rolling ending temp. (° C.) | Finish rolling start temp. (° C.) | Finish rolling ending temp. (° C.) | Rolling reduction ion (%) | Cooling rate (° C./s) | Cooling temp. (° C.) | Tempering temp. (° C.) | Tempering time (hour(s)) |
|---|---|---|---|---|---|---|---|---|---|---|---|
| Inventive material 1 | Inventive steel 1 | 244 | 1114 | 1049 | 946 | 870 | 50 | 5 | 235 | 558 | 3.0 |
| Inventive material 2 | Inventive steel 2 | 244 | 1075 | 980 | 934 | 837 | 59 | 20 | 241 | 581 | 2.5 |
| Inventive material 3 | Inventive steel 3 | 294 | 1055 | 998 | 885 | 798 | 49 | 4 | 233 | 569 | 1.0 |
| Inventive material 4 | Inventive steel 4 | 294 | 1086 | 1017 | 855 | 781 | 55 | 24 | 302 | 612 | 2.0 |
| Inventive material 5 | Inventive steel 5 | 244 | 1135 | 1064 | 880 | 780 | 63 | 19 | 399 | 592 | 1.0 |
| Inventive material 6 | Inventive steel 6 | 244 | 1061 | 981 | 943 | 847 | 42 | 15 | 284 | 618 | 2.0 |
| Comparative material 1 | Comparative steel 1 | 244 | 1097 | 1029 | 864 | 806 | 52 | 10 | 378 | 616 | 1.0 |
| Comparative material 2 | Comparative steel 2 | 244 | 1137 | 1060 | 905 | 812 | 57 | 25 | 237 | 592 | 1.0 |
| Comparative material 3 | Comparative steel 3 | 244 | 1148 | 1049 | 877 | 808 | 51 | 13 | 265 | 563 | 1.0 |
| Comparative material 4 | Comparative steel 4 | 294 | 1145 | 1069 | 923 | 833 | 58 | 12 | 254 | 565 | 1.0 |
| Comparative material 5 | Comparative steel 5 | 244 | 1058 | 992 | 873 | 774 | 44 | 24 | 311 | 561 | 2.0 |
| Comparative material 6 | Comparative steel 6 | 244 | 1101 | 1020 | 367 | 775 | 40 | 14 | 390 | 581 | 1.5 |
| Comparative material 7 | Inventive steel 2 | 294 | 1192 | 1120 | 1042 | 980 | 48 | 6 | 329 | 589 | 1.0 |
| Comparative material 8 | Inventive steel 3 | 244 | 1066 | 992 | 723 | 688 | 56 | 26 | 355 | 555 | 1.0 |
| Comparative material 9 | Inventive steel 6 | 244 | 1077 | 1022 | 878 | 791 | 24 | 12 | 256 | 578 | 3.5 |
| Comparative material 10 | Inventive steel 2 | 244 | 1123 | 1071 | 913 | 835 | 58 | 0.5 | 325 | 557 | 2.5 |
| Comparative material 11 | Inventive steel 3 | 294 | 1150 | 1061 | 939 | 880 | 40 | 17 | 489 | 620 | 2.0 |
| Comparative material 12 | Inventive steel 6 | 244 | 1120 | 1061 | 920 | 858 | 54 | 22 | 350 | 523 | 1.0 |
| Comparative material 13 | Inventive steel 2 | 244 | 1122 | 1043 | 891 | 805 | 61 | 15 | 221 | 672 | 1.5 |
| Comparative material 14 | Inventive steel 1 | 244 | 1145 | 1085 | 921 | 840 | 70 | 31 | 254 | 613 | 0.2 |
| Comparative material 15 | Inventive steel 2 | 244 | 1107 | 1040 | 888 | 822 | 54 | 29 | 304 | 628 | 5.5 |

The inventive materials 1-6 of the conditions in table 2 indicate that the inventive steels 1-6 are produced under conditions according to the rolling and heat treatment processes of the present invention. The comparative materials 1~15 indicate that the materials are produced according to the conditions that do not meet the conditions of the present invention. Also, the comparative materials 7-15 indicate that the steels having the composition range of the present invention (i.e., inventive steels 1, 2, 3 and 6) are produced according to the conditions that do not meet the rolling and heat treatment conditions of the present invention. Comparative materials 1-6 indicate that the steels beyond the composition range of the present invention (i.e., comparative steels 1-6) are produced according to the conditions that do not meet the rolling and heat treatment conditions of the present invention.

표 3

| | | Bainite fraction (%) | Austenite fraction (%) | Yield strength (MPa) | Tensile strength (MPa) | Elongation (%) | Cryogenic temperature impact energy (J) | remarks |
|---|---|---|---|---|---|---|---|---|
| Inventive material 1 | Inventive steel 1 | 2.4 | 9.1 | 670 | 780 | 24.2 | 162 | |
| Inventive material 2 | Inventive steel 2 | 1.5 | 11.4 | 663 | 773 | 22.0 | 150 | |
| Inventive material 3 | Inventive steel 3 | 3.1 | 9.2 | 600 | 708 | 20.1 | 173 | |
| Inventive material 4 | Inventive steel 4 | 1.3 | 8.4 | 607 | 715 | 22.9 | 99 | |
| Inventive material 5 | Inventive steel 5 | 4.5 | 8.9 | 624 | 733 | 20.7 | 127 | |
| Inventive material 6 | Inventive steel 6 | 3.2 | 6.8 | 644 | 754 | 24.1 | 92 | |
| Comparative material 1 | Comparative steel 1 | 82.6 | 4.6 | 477 | 587 | 28.1 | 21 | Low C |
| Comparative material 2 | Comparative steel 2 | 2.5 | 12.8 | 678 | 916 | 16.3 | 5 | Excessive C |
| Comparative material 3 | Comparative steel 3 | 37.5 | 4.4 | 548 | 606 | 25.3 | 42 | Low Mn Ni |
| Comparative material 4 | Comparative steel 4 | 0.5 | 4.2 | 654 | 764 | 20.9 | 19 | Low Mo |
| Comparative material 5 | Comparative steel 5 | 2.1 | 6.1 | 667 | 786 | 17.4 | 53 | Excessive Mn Ni |
| Comparative material 6 | Comparative steel 6 | 2.6 | 4.3 | 652 | 770 | 20.9 | 22 | Excessive Mn Ni |
| Comparative material 7 | Inventive steel 2 | 0.4 | 8.4 | 623 | 732 | 21.6 | 21 | Excessive starting temperature of rolling |
| Comparative material 8 | Inventive steel 3 | 1.5 | 7.4 | 673 | 889 | 17.4 | 23 | Low starting temperature of rolling |
| Comparative material 9 | Inventive steel 6 | 0.2 | 3.2 | 639 | 748 | 22.7 | 54 | Low rolling reduction |
| Comparative material 10 | Inventive steel 2 | 79.0 | 6.7 | 666 | 776 | 24.2 | 22 | Low cooling rate |
| Comparative material 11 | Inventive steel 3 | 92.0 | 6.0 | 653 | 763 | 23.6 | 39 | High ending temperature of cooling |
| Comparative material 12 | Inventive steel 6 | 1.5 | 1.2 | 649 | 759 | 19.4 | 42 | Low tempering temperature |
| Comparative material 13 | Inventive steel 2 | 2.2 | 28.4 | 629 | 790 | 24.6 | 12 | Excessive tempering temperature |
| Comparative material 14 | Inventive steel 1 | 1.7 | 0.4 | 681 | 711 | 16.1 | 3 | Low tempering time |
| Comparative material 15 | Inventive steel 2 | 2.1 | 20.5 | 602 | 776 | 29.1 | 32 | Excessive tempering time |

As shown in the table 3, the inventive steels having the composition according to present invention which are manufactured by the rolling, cooling and heat treatment processes of the present invention exhibit elongation of 18% or more, cryogenic impact energy of 70 J or more, yield strength of 585 MPa or more, and tensile strength of 680 MPa or more, and thus, show results high enough to be used as steel for cryogenic tanks.

However, the comparative materials 1 and 2 are produced to have the compositions of the comparative steels 1 and 2, respectively, and indicate that the amount of C is too low or too high. In the comparative material 1, the amount of C is below the amount of the present invention. During cooling after rolling, fine lath martensite is unable to be formed but coarse bainite without carbide is formed to cause the yield strength and tensile strength to be lowered, and thus the comparative material 1 is insufficient to be used as structural materials. Also, in the comparative material 2 in which the amount of C exceeds the amount of the present invention, it can be observed that the strength is increased greatly as the amount of C is increased; however, cryogenic temperature toughness may be inferior, because the impact energy is less than the range of the present invention.

The comparative materials 3, 5 and 6 are produced to have the compositions of the comparative steels 3, 5 and 6, respectively, and indicate that the amount of 1.5×Mn+Ni is beyond the range of the present invention. In the comparative material 3 in which the value of 1.5×Mn+Ni is less than 8, the hardenability of steel is lowered, and thus martensite is unable to be refined during cooling but coarse bainite is formed so that the cryogenic temperature toughness is poor, despite low strength. Also, in the comparative materials 5 and 6 in which the value of 1.5×Mn+Ni is greater than 12, it can be observed that the elongation and the cryogenic temperature toughness are less than target values because the strength is increased due to the effect of the solid solution strengthening.

The comparative material 4 has the composition of the comparative steel 4 and contains Mo in an amount smaller than the range of the present invention. The comparative material 4 is insufficient to suppress the brittleness caused by the segregation of unavoidable impurities, P during production, and therefore the cryogenic temperature toughness of the steel becomes lower than the reference.

The comparative materials 7 and 8 have the compositions of the comparative steel 2 and 3, respectively, which fall within the range of the present invention, but the starting and ending temperatures of the finishing rolling are beyond the range of the present invention. In the comparative material 7 in which the finishing rolling temperature is higher than the range of the present invention, the grains of austenite become coarse, so that cryogenic temperature toughness becomes lower than the reference. In the comparative material 8 having a low finishing rolling temperature, it is difficult to manufacture because the load of rolling is sharply increased, and the manufactured steel also have largely increased strength to cause cryogenic temperature toughness to be lowered.

The comparative material 9 has the composition of the inventive steel 6, which is within the range of the present invention, but total remaining rolling reduction of finishing rolling is smaller than the range of the present invention. If rolling reduction of the finishing rolling is decreased, the amount of austenite deformation is decreased to result in austenite grains being coarsened. Thus, the cryogenic temperature toughness of steel after final heat treatment is deteriorated.

The comparative material 10 has the composition of the inventive steel 10, within the range of the present invention, but the cooling rate after the finishing rolling is lower than the range of the present invention. For the superior cryogenic temperature toughness, deformed austenite after rolling should be transformed to fine martensite or bainite to have the fine microstructure by accelerated cooling. However, if a cooling rate is low, the steel is transformed to only the coarse bainite with the coarse cementite to have the coarse microstructure and deteriorated in cryogenic temperature toughness.

The comparative material 11 has the composition of the inventive steel 3, which is within the range of the present invention, but the finishing temperature of the cooling is beyond the range of the present invention. In the comparative material 11 which has the cooling ending temperature lower than the range of the present invention, austenite is not fully transformed to martensite but transformed to ferrite or coarse bainite so that the steel has a coarse microstructure finally. Therefore, the steel have the coarse microstructure consisting of the coarse bainite with the coarse cementite to lead to deterioration in cryogenic temperature toughness.

The comparative material 12 and 13 have the compositions of the inventive steels 6 and 2, respectively, which are within the range of the present invention, but the tempering temperature is out of the range of the present invention. In the comparative material 12 having the tempering temperature lower than the range of the present invention, the formation rate of the retained austenite within the martensite and the bainite during the accelerated cooling becomes slow and the softening of the martensite and the bainite itself is insufficient. Therefore, the strength is significantly increased but the softening is worsened, to thereby deteriorate cryogenic temperature toughness. Also, in the comparative material 13 which having the high tempering temperature, an excessive amount of the retained austenite is produced and the austenite is partially transformed to the martensite reversely during the cooling again to the room temperature or cryogenic temperature and also a portion of the austenite is easily strain-induced-transformed to the martensite during tensile or impact deformation. Eventually, the tensile strength and elongation are significantly increased but cryogenic temperature toughness is deteriorated Comparative materials 14 and 15 have the composition of the inventive steels 1 and 2, respectively, which are within the range of the present invention, but the tempering time is out of the range of the present invention. In the comparative material 14 having the tempering time shorter than the range of the present invention, the amount of the retained austenite formed within the martensite and the bainite during the accelerated cooling is insufficient and the softening of the martensite and the bainite itself is insufficient. Therefore, strength is significantly increased but toughness is lowered to deteriorate cryogenic temperature toughness. Also, in the comparative material 15 which has longer tempering time than the range of the present invention, the amount of the retained austenite becomes too much, as similar to the comparative material 13, and the austenite is partially re-transformed to martensite reversely during the cooling to the room temperature or a cryogenic temperature and a portion of austenite is easily strain-induced-transformed to the martensite during tensile or impact deformation. Eventually, the tensile strength and elongation are significantly increased but cryogenic temperature toughness is deteriorated.

As described above, when the steel having the composition according to the present invention is manufactured through the manufacturing method of the present invention, it is possible to achieve the excellent effect in cryogenic steel equivalent to 9% Ni steel which has been typically used, even by reducing the amount of relatively expensive Ni.

As described above, when the steel having the composition according to the present invention is manufactured through the manufacturing method of the present invention, it is possible to achieve the excellent effect in cryogenic steel equivalent to 9% Ni steel which has been typically used, even by reducing the amount of relatively expensive Ni.

According to the present invention, by optimally controlling an alloy composition and rolling, cooling and heat treatment processes, it is possible to manufacture high-strength structural steel with good cryogenic temperature toughness, an important property of cryogenic steel, even by reducing the amount of relatively expensive Ni.

While the present invention has been shown and described in connection with the exemplary embodiments, it will be apparent to those skilled in the art that modifications and variations can be made without departing from the spirit and scope of the invention as defined by the appended claims.

The invention claimed is:

1. High-strength steel with good cryogenic temperature toughness, comprising, by weight: 0.01-0.06% of carbon (C), 2.4-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (S), with a remainder of iron (Fe) and other unavoidable impurities, wherein the Mn and Ni satisfy the condition of $8 \leq 1.5 \times Mn + Ni \leq 12$, and wherein the steel has a yield strength of 500 MPa or more and a cryogenic impact energy of 70 J or more at −196° C. or less.

2. The high-strength steel with good cryogenic temperature toughness of claim 1, further comprising, by weight, at least one selected from the group consisting of 0.003-0.055 of titanium (Ti), 0.1-5.0% of chromium (Cr) and 0.1-3.0% of copper (Cu).

3. The high-strength steel with good cryogenic temperature toughness of claim 2, wherein said Mn, Ni, Cr and Cu satisfy the condition of $8 \leq 1.5 \times (Mn+Cr+Cu)+Ni \leq 12$.

4. The high-strength steel with good cryogenic temperature toughness of claim 1, wherein the steel has a main phase of martensite and 3-15 vol % of retained austenite.

5. The high-strength steel with good cryogenic temperature toughness of claim 1, wherein the steel has a main phase of martensite with a lath structure and 3-15 vol % of retained austenite.

6. The high-strength steel with good cryogenic temperature toughness of claim 1, wherein the steel has a main phase of martensite with a lath structure, 10 vol % or less of bainite and 3-15 vol % of retained austenite.

7. A method of manufacturing high-strength steel with cryogenic temperature toughness, comprising:

heating a steel slab to a temperature within a range of 1,000 to 1,250° C., the steel slab comprising, by weight: 0.01-0.06% of carbon (C), 2.4-8.0% of manganese (Mn), 0.01-6.0% of nickel (Ni), 0.02-0.6% of molybdenum (Mo), 0.03-0.5% of silicon (Si), 0.003-0.05% of aluminum (Al), 0.0015-0.01% of nitrogen (N), 0.02% or less of phosphorous (P), 0.01% or less of sulfur (S), with a remainder of iron (Fe) and other unavoidable impurities, wherein the Mn and Ni satisfy the condition of $8 \leq 1.5 \times Mn+Ni \leq 12$;

finish-rolling the heated slab at a temperature of 950° C. or less at a rolling reduction rate of 40% or more;

cooling the rolled steel to a temperature of 400° C. or less at a cooling rate of 2° C./s or more; and tempering the steel for 0.5-4 hours to a temperature within a range of 550 to 650° C. after the cooling.

8. The method of claim 7, wherein the steel slab further comprises, by weight, at least one selected from the group consisting of 0.003-0.055 of titanium (Ti), 0.1-5.0% of chromium (Cr) and 0.1-3.0% of copper (Cu).

9. The method of claim 8, wherein said Mn, Ni, Cr and Cu satisfy the condition of $8 \leq 1.5 \times (Mn+Cr+Cu)+Ni \leq 12$.

10. The method of claim 7, wherein the steel has a main phase of martensite and 3-15 vol % of retained austenite.

11. The method of claim 7, wherein the steel has a main phase of martensite with a lath structure and 3-15 vol % of retained austenite.

12. The method of claim 7, wherein the steel has a main phase of martensite with a lath structure, 10 vol % or less of bainite, and 3-15 vol % of retained austenite.

* * * * *